US005212423A

United States Patent [19]

Noguchi et al.

[11] Patent Number: 5,212,423

[45] Date of Patent: May 18, 1993

[54] ELECTRON GUN WITH LENS WHICH CHANGES BEAM INTO NONAXISYMMETRIC SHAPE

[75] Inventors: Kazunari Noguchi, Chiba; Syoji Shirai, Mobara, both of Japan

[73] Assignee: Hitachi, Ltd., Tokyo, Japan

[21] Appl. No.: 712,188

[22] Filed: Jun. 7, 1991

[30] Foreign Application Priority Data

Jun. 7, 1990 [JP] Japan ..... 2-147288

[51] Int. Cl.[5] ..... H01J 29/38; H01J 29/46

[52] U.S. Cl. ..... 313/414; 315/15; 315/382

[58] Field of Search ..... 313/414; 315/14, 15, 315/382

[56] References Cited

U.S. PATENT DOCUMENTS 4,967,120 10/1990 Katsuma et al. ..... 313/414 X

*Primary Examiner*—Sandra L. O'Shea

*Attorney, Agent, or Firm*—Antonelli, Terry, Stout & Kraus

[57] ABSTRACT

An electron gun has one first-type electron lens in the focusing electrode which changes the cross-sectional shape of the electron beam into a nonaxisymmetric shape with increase in the degree of the electron beam deflection by applying a first voltage varying in synchronism with deflection, and one second-type axisymmetric electron lens in the focusing electrode which weakens the lens power with increase in the degree of the electron beam deflection by applying a second voltage increasing with the degree of deflection.

15 Claims, 6 Drawing Sheets

ELECTRON GUN WITH LENS WHICH CHANGES BEAM INTO NONAXISYMMETRIC SHAPE

BACKGROUND OF THE INVENTION

The present invention relates to an electron gun for a cathode ray tube which is able to produce excellent beam spot shapes over the entire area of the screen independently controlling corrections for astigmatism and field curvature accompanying the electron beam deflection.

For an electron gun of the type used for a cathode ray tube, such as a television picture tube or a display tube, it is necessary to control the beam spot shape properly in accordance with the degree of the deflection angle in order to obtain a high resolution with excellent focus characteristics at all times over the entire area of the screen.

Electron guns of this kind have been disclosed, for example, in our Japanese Patent Laid-Open No. 72546/1990. The electron gun disclosed in this published Japanese application is provided with a first electrode unit (three-electrode unit) which generates a plurality of electron beams and directs these electron beams toward the screen along initial paths parallel to each other in one horizontal plane, and a second electrode unit which constitutes a main lens for focusing the aforesaid electron beams respectively on the screen. A focusing lens unit adjacent to the accelerating electrode of the two electrodes forming the main lens, to which the highest voltage is applied, comprises two electrode members. A first electrode member is adjacent to the accelerating electrode and is provided with an electron beam passage hole in an end surface thereof facing the second electrode member. Flat plate electrodes electrically connected to the first electrode member and sandwiching vertically the electron beam passage hole provided in the first electrode member are arranged to extend into the inside of the second electrode member through the single opening provided in the end surface of the second electrode member facing the first electrode member, which end surfaced faces the aforesaid flat plate electrodes with a constant interval. Further, the electron gun is so configured that an electrode plate having electron beam passages of the same diameter, extending in the direction parallel to the aforesaid horizontal plane, is electrically connected to the second electrode member. A voltage which varies in synchronism with the deflection required for scanning the plurality of electron beams on the screen is applied to the first electrode member.

In the above-described electron gun, in which the focusing lens adjacent to the accelerating electrode comprises a first electrode member and a second electrode member, a nonaxisymmetric electron lens (i.e., not circular at its cross section) is formed between the first electrode member and the second electrode member. Then, by applying to the first electrode member a voltage which varies in synchronism with the electron beam deflection, the cross-sectional shape of the electron beam is deformed to correct the astigmatism accompanying the deflection; and, at the same time, by providing the first electrode member adjacent to the accelerating member, the lens power of the main lens is varied in synchronism with the electron beam deflection to correct the field curvature in the peripheral part of the image on the screen.

However, in the above-mentioned structure, the correction of the field curvature is performed by only one main lens. Therefore, in order to balance the effect of the astigmatism correction by the electron lens formed of the first electrode member and the second electrode member of the focusing lens and the effect of the above-mentioned field curvature correction by the main lens, the astigmatism correction sensitivity should be reduced to match the astigmatism correction effect with the field curvature correction effect because the above-mentioned field curvature correction effect depends on the main lens. As a result, the application of a high dynamic voltage is required for the peripheral part of the screen.

In practice, however, because of the restriction imposed upon the circuitry of a television set, the applicable voltage should be lower than the voltage required to obtain an excellent image quality in the peripheral part of the screen. Thus, a problem is encountered in the prior arrangement in that the correction of astigmatism and field curvature cannot be performed sufficiently for the peripheral part of the screen, making it difficult to obtain an excellent image quality in the peripheral part of the screen.

SUMMARY OF THE INVENTION

An object of the present invention is to provide an electron gun for a cathode ray tube which is capable of obtaining an excellent image quality in the peripheral part of the screen by intensifying the astigmatism correction sensitivity independent of the field curvature correction effect produced by the use of the main lens.

This object is attained by providing an electron gun for a cathode ray tube having a structure in which the focusing lens unit adjacent to the accelerating electrode is divided into a plurality of electrode members. In addition to a first-type electron lens which changes the cross-sectional shape of an electron beam to a nonaxisymmetric shape according to the increase in the degree of the above-mentioned deflection by applying to the focusing lens unit a voltage in synchronism with at least one electron beam deflection signal, there is also provided at least one axisymmetric second-type electron lens which reduces its lens power in synchronism with the electron beam deflection by applying thereto a voltage in synchronism with the electron beam deflection.

By providing in the focusing lens unit an axisymmetric second-type electron lens which weakens the lens power in synchronism with the electron beam deflection, it becomes possible to correct the field curvature using elements other than the electrodes which form the main lens, thereby correcting the field curvature sufficiently in the peripheral part of the screen. Hence, it is possible to obtain an excellent image quality.

PREFERRED EMBODIMENTS OF THE INVENTION

Hereinafter, in conjunction with the accompanying drawings, the present invention will be described.

Figure 1:
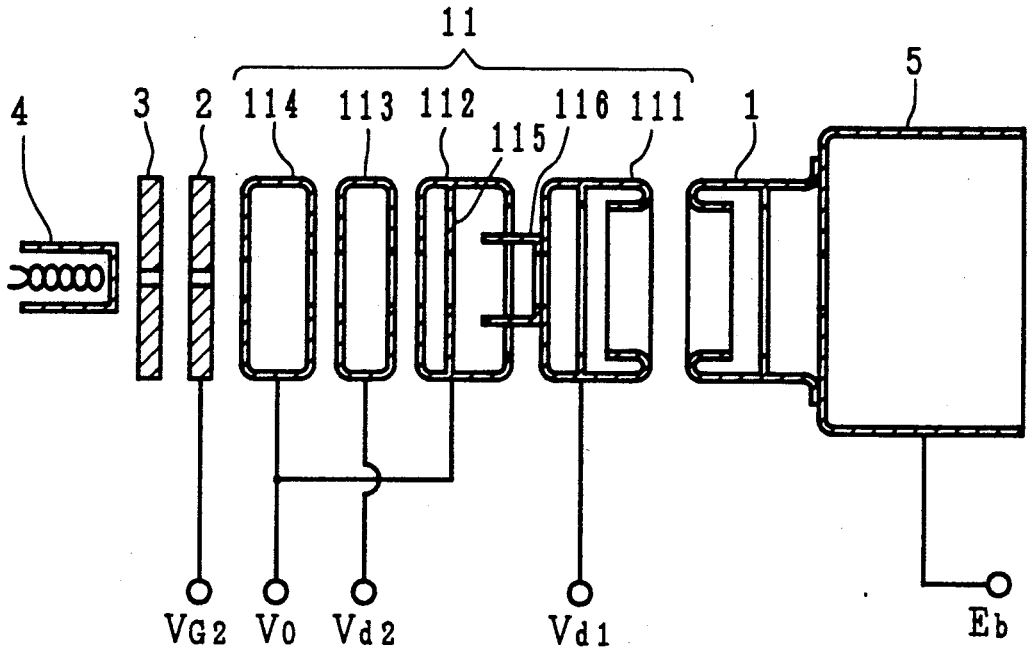
FIG. 1 is a schematic view illustrating the structure of an electron gun for a cathode ray tube according to the present invention.

FIG. 1 is a schematic view of an electron gun for a cathode ray tube according to the present invention having an accelerating electrode 1; a second electrode 2; a first electrode 3; a cathode 4; a shield cup 5; and a focusing lens 11, including a first electrode member 111, a second electrode member 112, a third electrode member 113, a fourth electrode member 114, an electrode plate 115, and flat plate correcting electrodes 116.

A first electrode unit (three-electrode unit) comprises the cathode 4, the first electrode 3, and the second electrode 2, and a second electrode unit comprises the accelerating electrode 1 and the focusing lens unit 11. To the accelerating electrode 1, the highest voltage Eb is applied, and a main lens is formed by the facing ends of this accelerating electrode 1 and the focusing electrode 11.

In the first electrode member 111, three circular passage holes for the electron beams are provided at the end surface facing the second electrode member 112, and the flat plate correcting electrodes 116 extending towards the second electrode 112 are arranged above and below the aforesaid electron beam passage holes.

In the second electrode member 112, an oblong opening having its major axis in a single horizontal direction is provided, and at the same time the electrode plate 115 provided with three electron beam passage holes is arranged in the inside thereof.

In the third electrode member 113, three circular passage holes for the electron beams are provided at end surfaces thereof facing the second electrode member 112 and the fourth electrode member 114, and in the fourth electrode member 114, three circular passage holes for the electron beams are provided in the end surface thereof facing the third electrode member 113.

To the first electrode member 111, a first voltage (Vd1) which varies in synchronism with the electron beam deflection is applied. Also, to the third electrode 113, a second voltage (Vd2) which varies in synchronism with the electron beam deflection is applied. The second electrode member 112 is electrically connected to the fourth electrode member 114, and a certain constant voltage (V0) is applied thereto.

When the electron beam is deflected, the power of the quadruple lens formed at the facing end surfaces of the first electrode member 111 and the second electrode member 112 is intensified if the voltage (Vd1) is increased with the degree of the electron beam deflection voltage within the range of $Vd1 \geqq V0$; thus correcting the astigmatism due to the electron beam deflection. At the same time, the voltage difference between the accelerating voltage Eb on the accelerating electrode 1 and the voltage Vd1 applied to the first electrode member 111 is narrowed, and the lens power of the main lens is lowered. Accordingly, the distance between the main lens and the focal point of the electron beam increases, making it possible to focus the electron beam even in the peripheral part of the screen.

Also, in accordance with the present invention, when the electron beam is deflected, by increasing or decreasing the voltage Vd2 according to the increasing degree of the electron beam deflection, the lens power of the electron lens formed by the second electrode member 112, third electrode member 113 and fourth electrode member 114 becomes small because of the decrease of the value :V0–Vd2:. Accordingly, the field curvature in the peripheral part of the screen can be corrected.

Therefore, the above-mentioned quadruple-electrode lens can be provided and controlled separately from the field curvature correction effect of the main lens, and the insufficiency of the field curvature correction effect when the astigmatism correction is satisfactory can be compensated by the electron lens formed by the second electrode member 112, third electrode member 113 and fourth electrode member 114, independent of the main lens.

Figure 2:
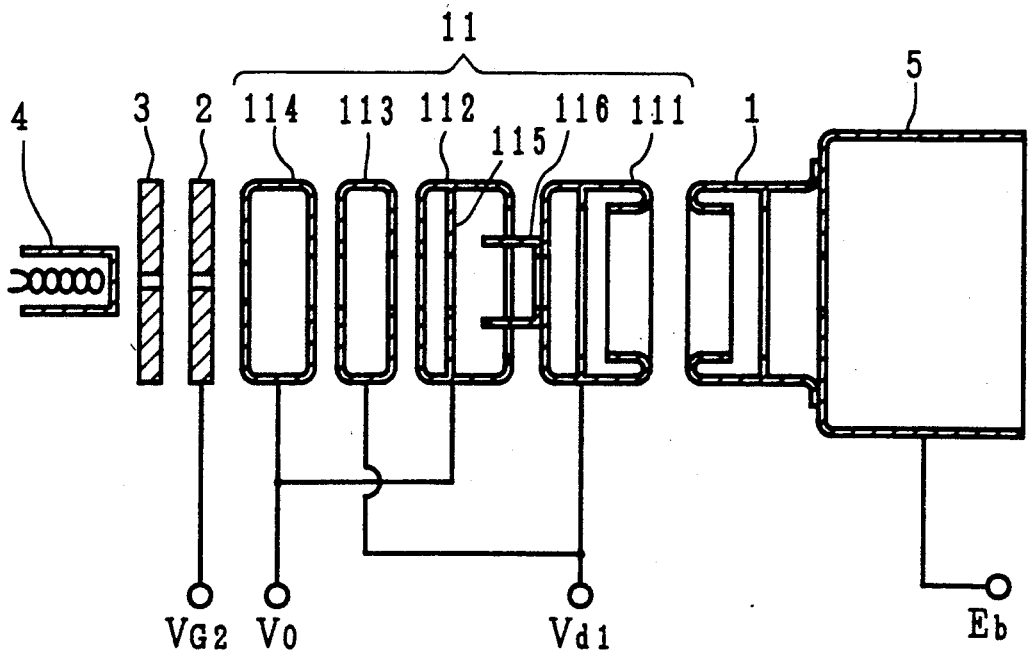
FIG. 2 is a schematic view illustrating the structure of FIG. 1 in which Vd2=Vd1.

Although it is indicated with respect to FIG. 1 that separate deflection voltages Vd1 and Vd2 are applied to the electrodes 111 and 113, respectively, it is possible to apply the same deflection voltage to these electrodes, as seen in FIG. 2, in which the same reference numerals appearing in FIG. 1 correspond to the same members. In the structure shown in FIG. 2, the first electrode member 111 and the third electrode member 113 are electrically connected. With this structure, only one voltage (Vd1) is used which varies with the degree of the increasing deflection of the electron beam. By using the main lens formed of the accelerating electrode 1 and the first electrode member 111 and shaped for focusing the electron beam stronger in the horizontal direction than in the vertical direction when $Vd1 = V0$, it is possible to increase Vd1 with the degree of the electron beam deflection within the range of $Vd1 \leqq V0$. In other words, by adjusting the voltage as $Vd1 < V0$, the electron beam can be focused by the quadruple lens strongly in the vertical direction, while the electron beam is not deflected. Thus, the lens effect of the main lens unit which focuses the electron beam strongly in the horizontal direction is offset by the lens effect of the quadruple lens, so that circular electron beam spots can be formed in the central part of the screen.

On the other hand, while the electron beam is deflected, the effect of the quadruple-electrode lens can be weakened by increasing Vd1 closely to V0, and the field curvature is offset by the lens effect of the main lens to decrease the spot diameter in the peripheral part of the screen. At this juncture, the lens power of the main lens is also weakened. Consequently, the field curvature is corrected simultaneously.

Further, the lens power of the electron beam formed by the second electrode member 112, third electrode member 113 and fourth electrode member 114 is reduced as the degree of the electron beam deflection is increased. Therefore, the field curvature is corrected to compensate the field curvature of the main lens, thereby further reducing the beam spot diameter.

The arrangement of FIG. 2 enables the application of only one kind of voltage which is varied in synchronism with the electron beam deflection, which is practical because its operation circuit is simple. In this respect, when the first voltage of the main lens formed by the accelerating electrode 1 and the first electrode member 111 is Vd1=V0, a main lens which provides a stronger function of focusing an electron beam in the horizontal direction than in the vertical direction can be implemented by the electron gun disclosed in Japanese Patent Laid-Open No. 103752/1983.

Figure 3A:
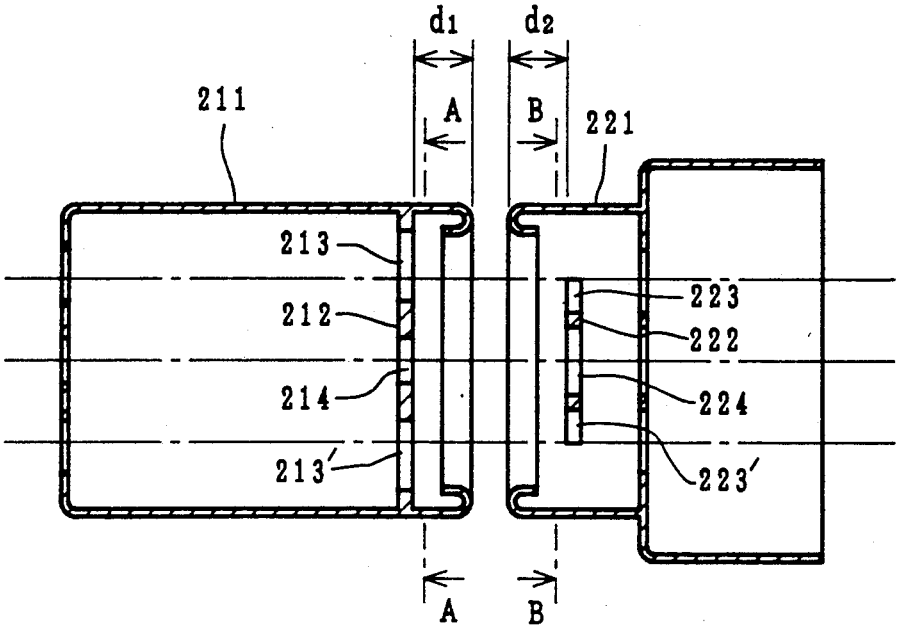
FIG. 3*a* is a schematic view illustrating the structure of an accelerating electrode and a first electrode member for forming a main lens in an electron gun for a cathode ray tube according to the present invention.
Figure 3B:
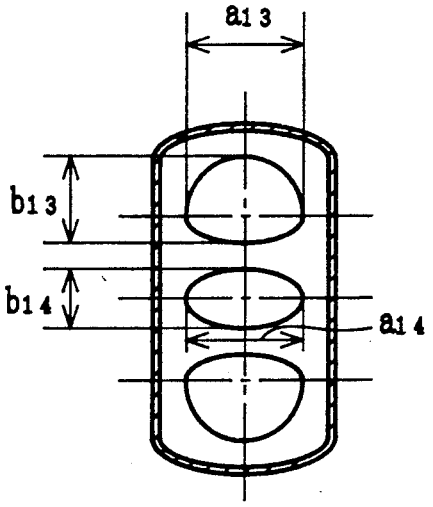
FIG. 3*b* is a cross-section view taken along line A—A of FIG. 3*a;*
Figure 3C:
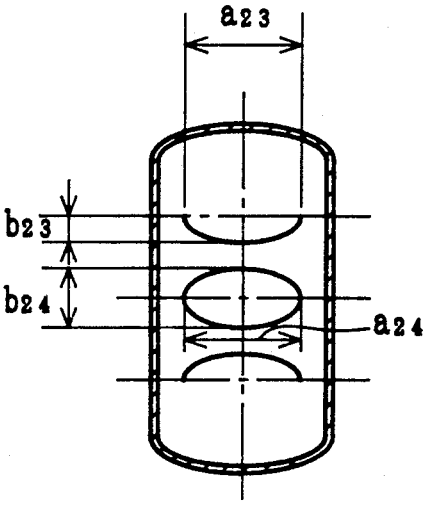
FIG. 3*c* is a cross-section view taken along line B—B of FIG. 3*a;*

FIG. 3*a* is a cross-sectional view showing the principal parts of an accelerating electrode 221 and first electrode member 211 constituting a bipotential type main lens having a function of more strongly focusing an electron beam in the horizontal direction than in the vertical direction where Vd1=V0. In FIG. 3*a*, an electrode plate 212 is provided for correcting the astigmatism provided in the inside of the first electrode member 211; and an electrode plate 222 for correcting astigmatism is provided inside of the accelerating electrode 221.

In the electrode plate 212, there are provided in line an opening 214 through which the central beam passes and openings 213 and 213' through which the outer beams pass; and also, in the electrode plate 222, an opening 224 is provided through which the central beam passes, and openings 223 and 223' are provided through which the outer beams pass. These openings 213, 213', 214, 223, 223' and 224 are oblong, and the shapes and dimensions of the openings in the first electrode member 211 are the same as those of the accelerating electrode 221.

With such a structure, it is possible to make the focusing function stronger in the horizontal direction than in the vertical direction by determining appropriately the retracting length d1 of the electrode plate 212 from the opening end of the first electrode member 211, the retracting length d2 of the electrode plate 222 from the opening end of the accelerating electrode 221, the horizontal diameter b13 and the vertical diameter a13 of the openings 213 and 213', and the horizontal diameter b24 and the vertical diameter a24 of the opening 224.

Figure 4:
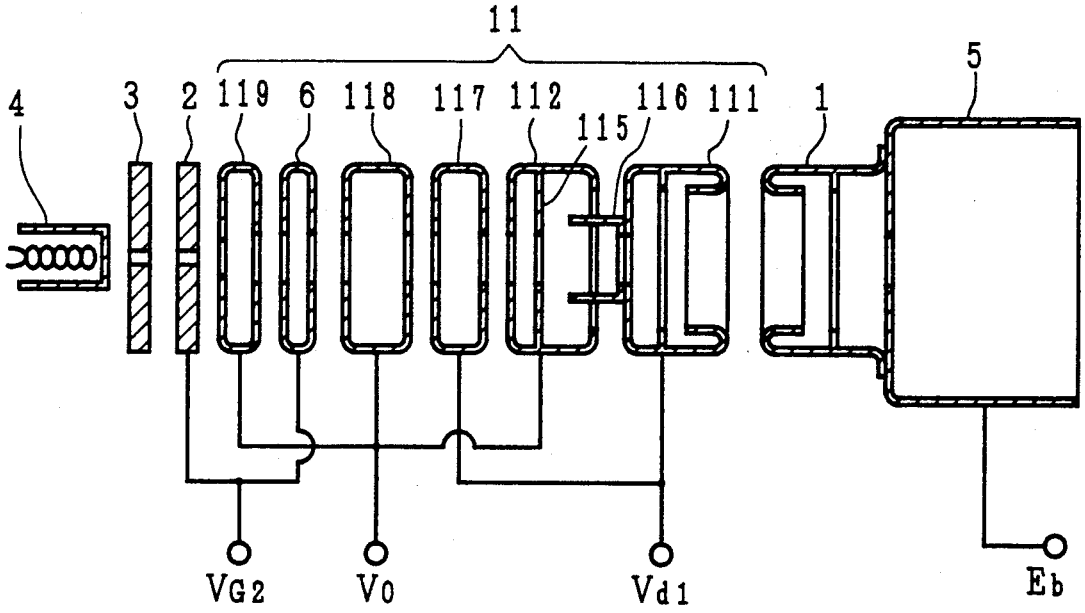
FIG. 4 schematic view illustrating the structure of an electron gun for a cathode ray tube according to the present invention.

In FIG. 4, a focusing lens unit 11 adjacent to an accelerating electrode 1 is divided into a plurality of electrode members, a first electrode member 111, a second electrode member 112, a third electrode member 117, a fourth electrode member 118 and a fifth electrode member 119. In the second electrode member 112, a single oblong opening is provided and at the same time, and electrode plate 115 having three circular electron beam passage holes is arranged in the inside thereof. In the first electrode member 111, three circular electron beam passage holes are provided in the end surfaces thereof facing the second electrode member 112, and above and below these electron beam passage holes, flat plate correction electrodes 116 are arranged, extending towards the second electrode member 112.

In the third electrode member 117, three circular electron beam passage holes are respectively provided in the end surfaces thereof facing the second electrode member 112 and the fourth electrode member 118. Also, between the fourth electrode member 118 and the fifth electrode member 119, a fourth electrode electrically connected to a second electrode 2 is provided. In the fourth electrode member 118, three circular electron beam passage holes are respectively provided in the end surfaces thereof facing the third electrode member 117 and the fourth electrode 6; and, in the fifth electrode member 119, three circular electron beam passage holes are provided in the end surface thereof facing the fourth electrode 6.

The first electrode member 111 and the third electrode member 117 are electrically connected, and the voltage Vd1 which varies in synchronism with the electron beam deflection is applied thereto. Also, the second electrode member 112, the fourth electrode member 118 and the fifth electrode member 119 are electrically connected, and a certain constant voltage V0 is applied thereto.

With a structure as seen in FIG. 4, it is possible to obtain an effect produced by the first electrode member 111, the second electrode member 112, the third electrode member 117 and the fourth electrode member 118 which is equivalent to the effect produced by the first electrode member 111, the second electrode member 112, the third electrode member 113 and the fourth electrode member 114 of the embodiment shown in FIG. 2. In addition, by providing a unipotential lens made up of the fourth electrode 6, the fourth electrode member 118 and the fifth electrode member 119, a multistage focusing type electron gun can be configured to implement a further improvement of its focusing performance.

Figure 5:
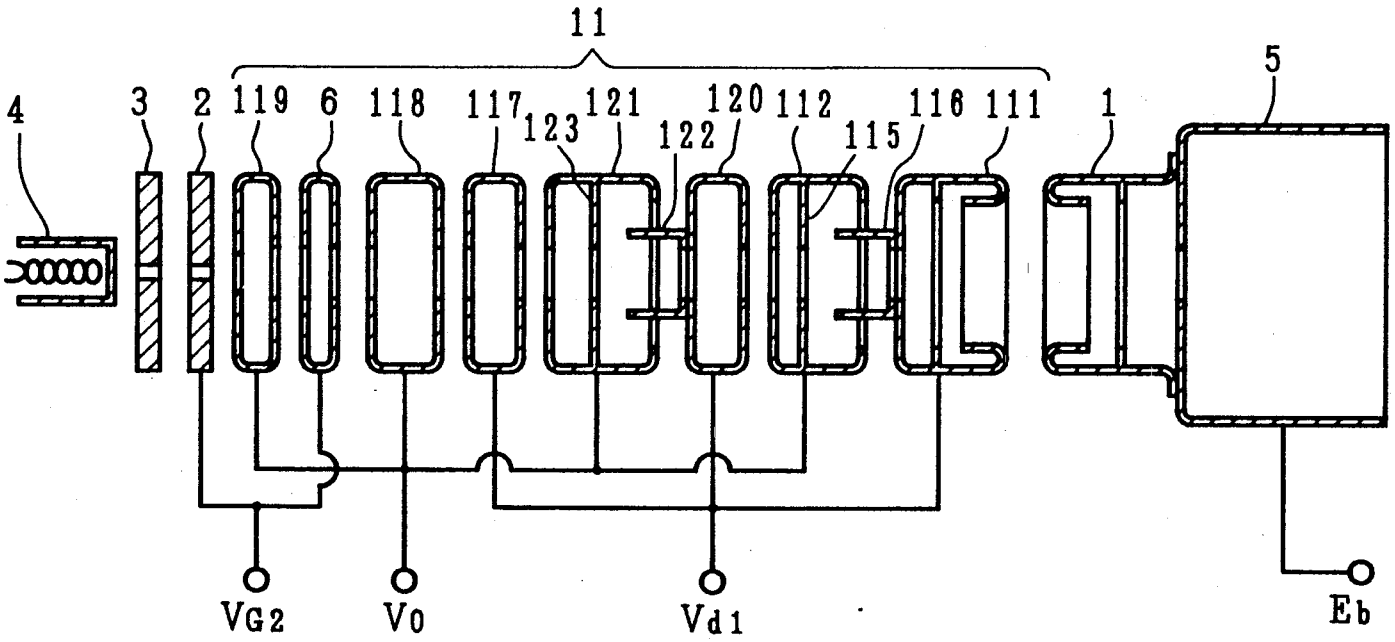
FIG. 5 is a schematic view illustrating the structure of an electron gun for a cathode ray tube according to the present invention.

In the embodiment shown in FIG. 5, a sixth electrode member 120 and a seventh electrode member 121 are further added between the second electrode member 112 and the third electrode member 117 provided in the structure of the embodiment shown in FIG. 4.

In the seventh electrode member 121, a single oblong opening is provided, and an electrode plate 123 having three circular electron beam passage holes are arranged in the inside thereof. In the sixth electrode member 120, three circular electron beam passage holes are provided in its end surface facing the seventh electrode member 121, and above and below the aforesaid electron beam passage holes, flat plate correction electrodes 122 are arranged extending towards the seventh electrode member 121. In the end surface of the sixth electrode member 120 facing the second electrode member 112, three circular electron beam passage holes are provided, and in the end surface of the seventh electrode member 121 facing the third electrode member 117, three circular electron beam passage holes are provided.

The sixth electrode member 120 is electrically connected to the first electrode member 111 and the third electrode member 117, and a voltage Vd1 which varies in synchronism with the electron beam deflection is applied thereto. Also, the seventh electrode member 121 is electrically connected to the second electrode member 112, the fourth electrode member 118, and the fifth electrode member 119 and a certain constant voltage V0 is applied thereto.

With such a structure, it is possible to obtain an effect between the sixth electrode member 120 and the seventh electrode member 121 which is equivalent to the effect produced between the first electrode member 111 and the second electrode member 112, thereby improving the astigmatism correction sensitivity for the voltage Vd1 which varies in synchronism with the electron beam deflection, i.e., an effect that the cross-sectional shape of the electron beam is changed within the focusing electrode. As a result, its focusing characteristic is further improved.

Particularly, if the main lens formed of the accelerating electrode 1 and the first electrode member 111 is constructed to focus the electron beam stronger in the horizontal direction than in the vertical direction under a condition of $Vd1 \leqq V0$, and if the voltage Vd1 is increased with electron beam deflection within the region of $Vd1 \leqq V0$ at all times, the lens power of the electron lenses formed respectively of the accelerating electrode 1 and the first electrode member 111, the second electrode member 112 and the sixth electrode member 120, the seventh electrode member 121 and the third electrode member 117, and the third electrode member 117 and the fourth electrode member 118 is weakened. Accordingly, the distance between the main lens and the focal point of the electron beam elongates, and the field curvature accompanying the electron beam deflection can be corrected effectively by a plurality of lenses. As a result, it is possible to further improve the focusing characteristic in the peripheral part of the screen.

In this respect, if the number of divisions of the focusing lens 11 in the structure shown in FIG. 5 is further increased, it is possible to perform even an more effective correction of the deflection astigmatism and the field curvature.

Figure 6:
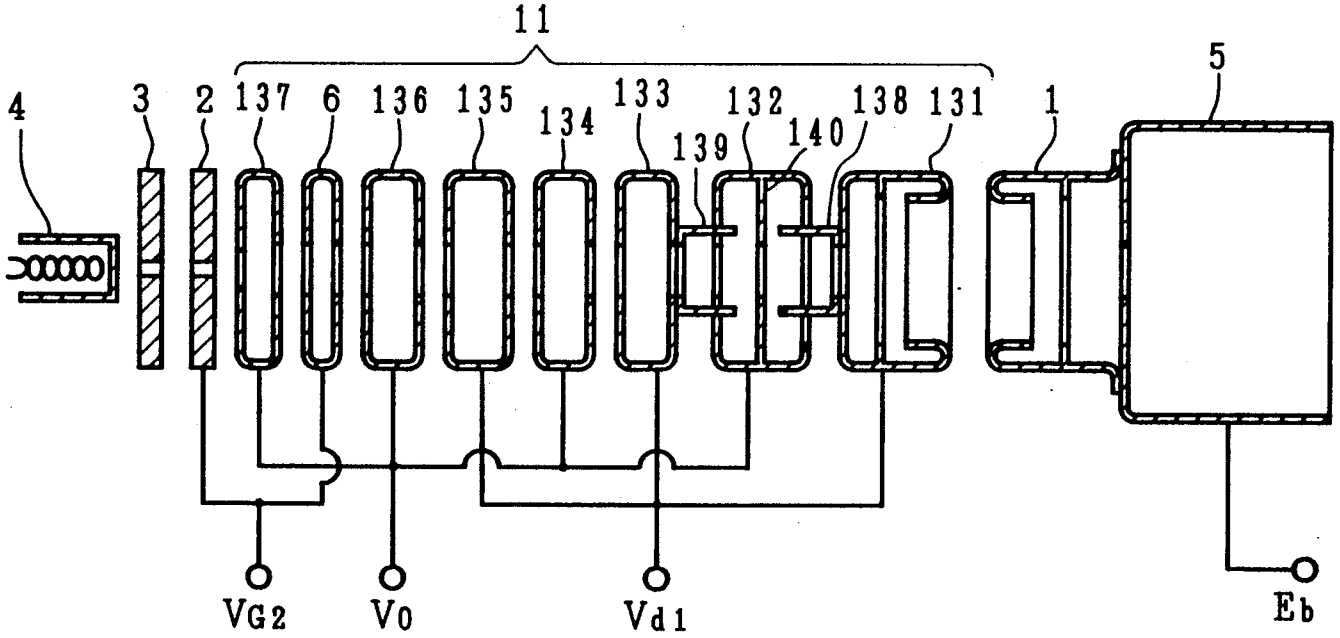
FIG. 6 is a schematic view illustrating the structure of an electron gun for a cathode ray tube according to the present invention.

In FIG. 6, a focusing lens unit 11 adjacent to an accelerating electrode 1 is divided into a plurality of electrode members, including a first electrode member 131, a second electrode member 132, a third electrode member 133, a fourth electrode member 134, a fifth electrode member 135, a sixth electrode member 136 and a seventh electrode member 137.

In the first electrode member 131, three circular electron beam passage holes are provided in its end surface facing the second electrode member 132, and above and below the aforesaid electron beam passage holes, the flat plate correction electrodes 138 are provided extending towards the second electrode member 132.

In the second electrode member 132, a single oblong opening is provided on each side in the direction towards the first electrode member 131 and the third electrode member 133, and an electrode plate 140 having three circular electron beam passage holes is arranged inside of the second electrode member 132.

In the third electrode member 133, three circular electron beam passage holes are provided in its end surface facing the second electrode member 132 and above and below the aforesaid electron beam passage holes, the flat plate correction electrodes 139 are arranged extending towards the second electrode member 132. Also, in the end surface of the third electrode member 133 facing the fourth electrode member 134, three circular electron beam passage holes are provided.

In the fourth electrode member 134, three circular electron beam passage holes are provided in its end surfaces facing respectively the third electrode member 133 and the fifth electrode member 134; and, in the fifth electrode member 135, three circular electron beam passage holes are provided in its end surface facing respectively the fourth electrode member 134 and the sixth electrode member 136.

Also, a sixth electrode 6 electrically connected to a second electrode 2 is provided between the sixth electrode member 136 and the seventh electrode member 137. In the sixth electrode member 136, three circular electron beam passage holes are provided in its end surfaces respectively facing the fifth electrode member 135 and the sixth electrode 6.

The first electrode member 131 is electrically connected to the third electrode member 133 and the fifth electrode member 135, and a voltage Vd1 which varies in synchronism with the electron beam deflection is applied thereto. Also, the second electrode member 132 is electrically connected to the fourth electrode member 134, the sixth electrode member 136 and the seventh electrode member 137, and a Certain constant voltage V0 is applied thereto.

With such a structure, it is possible to obtain an effect by the first electrode member 131 and the second electrode member 132, and the third electrode member 133 and the second electrode member 132, which is the same as the effect obtainable by the first electrode member 111 and the second electrode member 112 of the arrangement of FIG. 1.

Thus, it becomes possible to dispose an electron lens, which changes the cross-sectional shape of the electron beam in synchronism with the electron beam deflection, closer to the acceleration electrode 1 as compared with the above-mentioned embodiment in FIG. 5, and the distance between the above-mentioned lens which changes the cross-sectional shape of the electron beam and the crossover point elongates. Thus, the astigmatism correction sensitivity of the aforesaid electronic lens is enhanced.

Meanwhile, it is possible to supplement the field curvature correction of the main lens formed of the accelerating electrode 1 and the first electrode member 131 by lens effects produced between the respective electrode members, the third electrode member 133 and fourth electrode member 134, the fourth electrode member 134 and fifth electrode member 135, and the fifth electrode member 135 and sixth electrode member 136. The main lens of the electron gun according to this construction may be used as a main lens having a function of focusing the electron beam more strongly in the horizontal direction than in the vertical direction, when $Vd1 = V0$, as in the aforesaid embodiments in FIG. 2, FIG. 4 and FIG. 5. The number of division of the focusing electrode may also be increased.

In each of the aforesaid constructions, the first voltage Vd1 and the second voltage Vd2, which vary in synchronism with the electron beam deflection, can be the same value. If the voltages are different, it is also possible to obtain each of the voltages from a single power source by the use of a resistive dividing means or the like.

Figure 7:
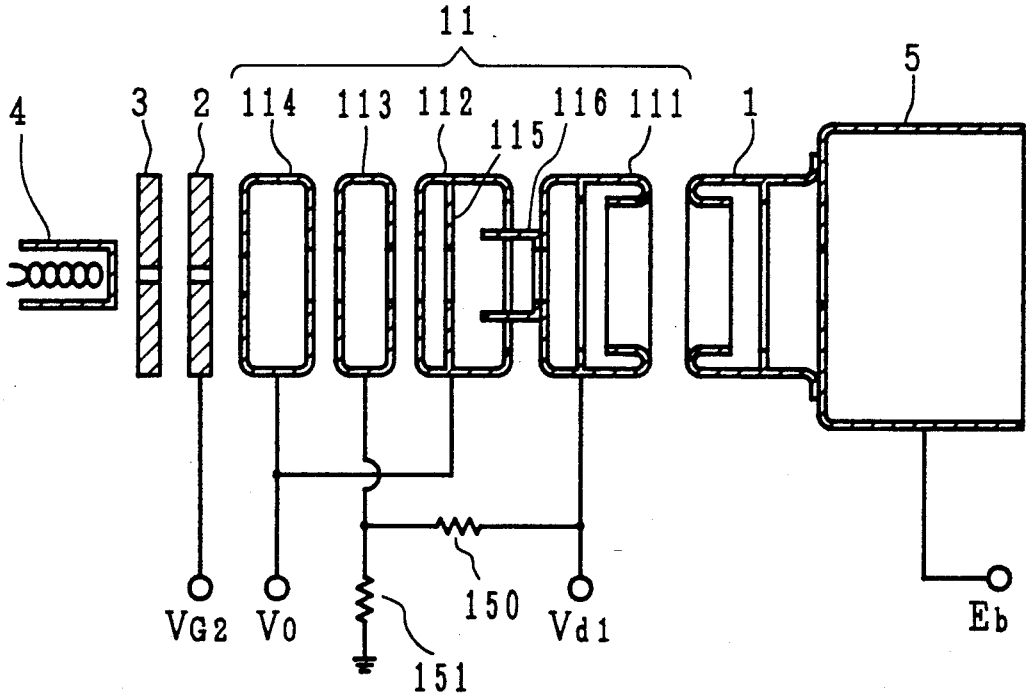
FIG. 7 is a schematic view showing how the structure of FIG. 1 is supplied with deflection voltages Vd1 and Vd2 from a single deflection voltage.

For example, as seen in FIG. 7, the first electrode member 111 and the third electrode member 113 in the structure shown in FIG. 1 are electrically connected in the tube of the cathode ray tube through a first resistor 150 while the third electrode member 113 is grounded through a second resistor 151 in the tube of the cathode ray tube. With such a structure, it is possible to supply different voltages respectively to the first electrode member 111 and the third electrode member 113.

In accordance with the present invention, it is possible to correct independently the astigmatism and the field curvature accompanying the electron beam deflection and enhance the effect of the astigmatism and field curvature corrections to obtain excellent beam spots over the entire area of the screen. Hence, an electron gun for a cathode ray tube which is able to implement a high-resolution image of excellent quality can be provided according to the present invention.

While the present invention has been described in terms of its preferred embodiments, it should be understood that numerous modifications may be made thereto without departing from the spirit and scope of the invention as defined in the appended claims. It is intended that all such modifications fall within the scope of the appended claims.

What is claimed is:

1. A cathode ray tube having an electron gun for producing electron beams which are to be scanned across a screen in response to deflection thereof, comprising:

first electrode means for generating a plurality of electron beams and directing the electron beams along initial paths parallel to each other in a horizontal plane; and second electrode means disposed along said initial paths and including a focusing lens unit positioned adjacent to an accelerating electrode to which a highest voltage is applied for forming therebetween a main lens to focus said electron beams on the screen, said focusing lens unit having a plurality of electrode members forming at least one first-type electron lens which changes the cross-sectional shape of said electron beam into a nonaxisymmetric shape with increase in the degree of electron beam deflection in response to a first voltage varying in synchronism with said deflection and at least one second-type axisymmetric electron lens, separate from said main lens, whose lens power is weakened with increase in the degree of the electron beam deflection in response to a second voltage increasing with the degree of said electron beam deflection.

2. A cathode ray tube having an electron gun according to claim 1, wherein a trio of electrode members is provided in said focusing lens unit adjacent to said first electrode means, and wherein a constant voltage different from said first voltage and second voltage is applied to a central electrode member of said trio to form a unipotential lens.

3. A cathode ray tube having an electron gun according to claim 1, wherein at least one of the electrode members forming said first-type electron lens and receiving said first voltage is electrically connected to at least one of the electrode members forming said second-type electron lens and receiving said second voltage through a resistor.

4. A cathode ray tube having an electron gun according to claim 1, wherein said first voltage Vdl is applied to at least one of the electrode members forming said first-type electron lens and a constant voltage V0 is applied to one of the remaining electrode members forming said first-type electron lens, and wherein the voltages Vd1 and V0 are set as $Vd1 \leqq V0$.

5. A cathode ray tube having an electron gun according to claim 1, characterized in that said first voltage and the second voltage are equal.

6. A cathode ray tube having an electron gun according to claim 1, characterized in that said main lens formed between the accelerating electrode and said focusing lens unit in said second electrode means has a stronger focusing function in the horizontal direction than in the vertical direction when the potentials of all electrode members of said focusing lens unit are equal.

7. A cathode ray tube having an electron gun according to claim 1, wherein said first voltage is greater than said second voltage.

8. A cathode ray tube having an electron gun according to claim 1, wherein said at least one first-type electron lens is formed downstream of said at least one second-type axisymmetric electron lens along said initial paths.

9. A cathode ray tube having an electron gun according to claim 1, wherein said focusing lens unit includes electrode members which form at least two first-type electron lenses.

10. A cathode ray tube having an electron gun according to claim 9, wherein said two first-type electron lenses are formed by four adjacent electrode members.

11. A cathode ray tube having an electron gun according to claim 9, wherein said two first-type electron lenses are formed by three adjacent electrode members.

12. A cathode ray tube having an electron gun according to claim 9, wherein a trio of electrode members is provided in said focusing lens unit adjacent t said first electrode means, and wherein a constant voltage different from said first voltage and second voltage is applied to a central electrode member of said trio to form a unipotential lens.

13. A cathode ray tube having an electron gun according to claim 1, wherein at least one of the electrode members forming said first-type electron lens and receiving a constant voltage is electrically connected to at least one of the electrode members forming said second-type electron lens.

14. A cathode ray tube having an electron gun according to claim 1, wherein said first voltage is also applied to one of said plurality of electrode members adjacent to said accelerating electrode to weaken lens power of said main lens with increase in the degree of said electron beam deflection.

15. A cathode ray tube having an electron gun for producing electron beams which are to be scanned across a screen in response to deflection thereof, comprising:

first electrode means for generating a plurality of electron beams and directing the electron beams along initial paths parallel to each other in a horizontal plane; and second electrode means disposed along said initial paths and including a focusing lens unit positioned adjacent to an accelerating electrode to which a highest voltage is applied for forming therebetween a main lens to focus said electron beams on the screen, said focusing lens unit having a plurality of electrode members forming at least one first-type electron lens which changes the cross-sectional shape of said electron beam into a nonaxisymmetric shape with increase in the degree of electron beam deflection in response to a first voltage varying in synchronism with said deflection and at least one second-type axisymmetric electron lens whose lens power is weakened with increase in the degree of the electron beam deflection in response to a second voltage increasing with the degree of said electron beam deflection;

characterized in that said first voltage and the second voltage are equal;

and characterized in that said main lens formed between the accelerating electrode and said focusing lens unit in said second electrode means has a stronger focusing function in the horizontal direction than in the vertical direction when the potentials of all electrode members of said focusing lens unit are equal.

* * * * *